US007128016B2

(12) United States Patent
Olthuis

(10) Patent No.: US 7,128,016 B2
(45) Date of Patent: Oct. 31, 2006

(54) METHOD FOR PRODUCING A FLOATING BASE

(75) Inventor: Jan Koen Olthuis, Delft (NL)

(73) Assignee: Dutch Docklands International B.V., Egmond Aan Zee (NL)

( * ) Notice: Subject to any disclaimer, the term of this patent is extended or adjusted under 35 U.S.C. 154(b) by 0 days.

(21) Appl. No.: 11/098,541

(22) Filed: Apr. 5, 2005

(65) Prior Publication Data

US 2006/0219148 A1 Oct. 5, 2006

(30) Foreign Application Priority Data

Mar. 31, 2005 (EP) ..... 05102565

(51) Int. Cl.
*B63B 35/44* (2006.01)

(52) U.S. Cl. ..... 114/266; 114/267

(58) Field of Classification Search ..... 114/263, 114/266, 267, 264; 405/218, 219
See application file for complete search history.

(56) References Cited

U.S. PATENT DOCUMENTS

| | | | | |
|---|---|---|---|---|
| 2,892,433 | A * | 6/1959 | Walker | 114/266 |
| 3,546,773 | A * | 12/1970 | Gerstin | 114/266 |
| 3,785,312 | A * | 1/1974 | Schneider | 114/266 |
| 4,067,285 | A * | 1/1978 | Jones et al. | 114/266 |
| 5,044,296 | A | 9/1991 | Finn | 114/263 |
| 6,199,502 | B1 * | 3/2001 | Mattson | 114/266 |

* cited by examiner

*Primary Examiner*—Lars A. Olson
(74) *Attorney, Agent, or Firm*—Harness, Dickey & Pierce, P.L.C.

(57) ABSTRACT

Method for producing a floating base, which base is made up of a number of coupled-together base elements, characterized in that floating elements and rigid elements are supplied first, after which a number of floating elements and a number of rigid elements are joined together, wherein each base element is assembled from floating elements and rigid elements that have been joined together in this manner, after which a number of base elements thus formed are coupled together so as to form the floating base.

9 Claims, 16 Drawing Sheets

METHOD FOR PRODUCING A FLOATING BASE

Figure 1:
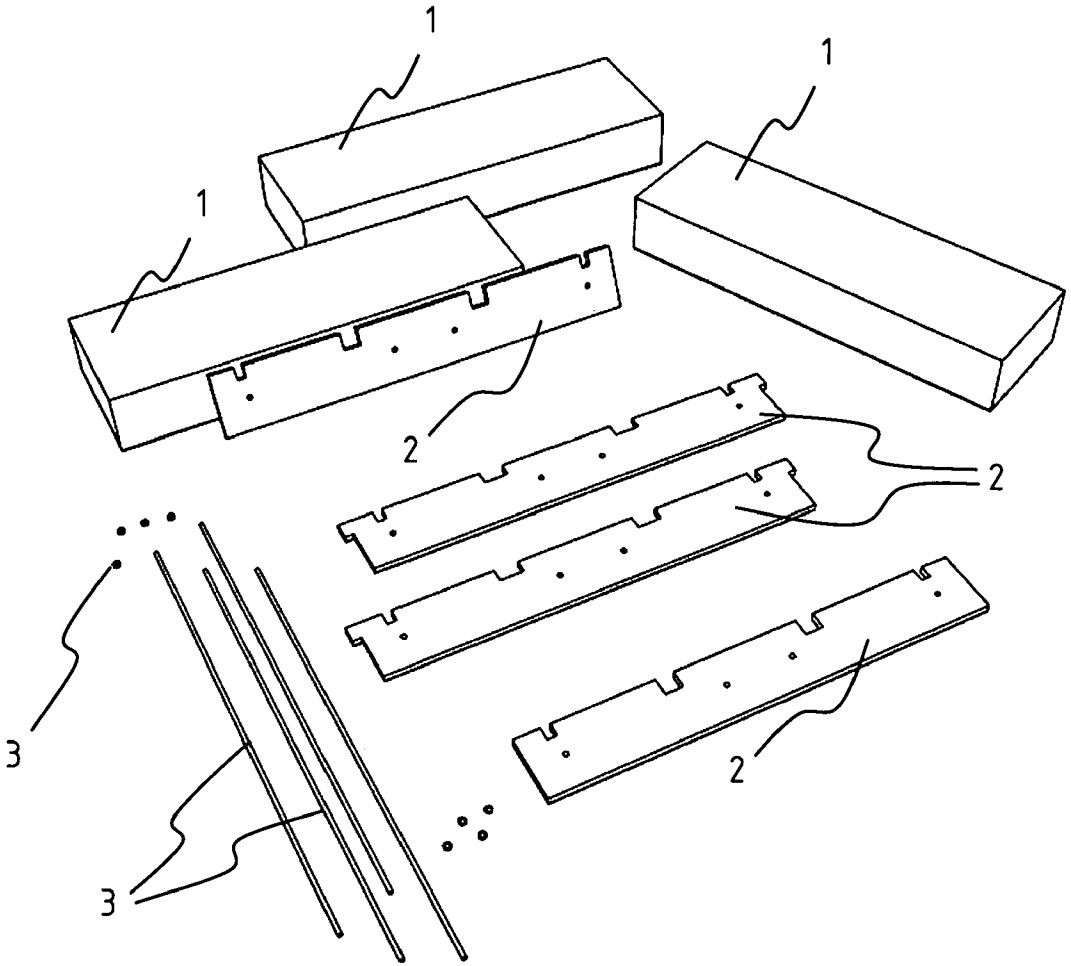

The invention relates to a method for producing a floating base, which base is made up of a number of coupled-together base elements. The base according to the invention, which floats on water, is in particular suitable for placing at least a building, such as a house, a row of houses or an office building, and/or any other structure, such as an airfield or a soccer field, a restaurant, a hotel, a church, a garden or a park thereon.

It is noted that the demand for floating building lots for use as the base structure in particular for buildings, squares, roads and green areas is increasing worldwide. In particular the demand for building space in the vicinity of towns and cities and the like is increasing. Essential is that floating building lots are stable and consequently do not exhibit any unacceptable swell-induced rolling motion.

Such a method is known from U.S. Pat. No. 5,044,296 (Finn). The known method employs coupled-together floating modules, in particular for assembling a dock. Said floating modules are each built up of block of a foam material ("Styrofoam"), on which a protective coating has been sprayed so as to prevent water penetrating the foam material. Each floating module is furthermore provided at the upper side thereof with a cover layer consisting of glass fibre-reinforced concrete. Rods projecting from the blocks function to connect adjacent modules.

One drawback of the method disclosed in the aforesaid US patent publication is the fact that the floating modules are constructed in a laborious and complex process, whilst the materials that are used are not always readily available at any place on earth. Because of this, the aforesaid method according to the prior art has a limited applicability.

The object of the invention is to overcome the drawbacks of the prior art and in particular to propose an inexpensive and simple method for producing a stable base that floats on water, wherein the base is assembled from a number of coupled-together, simple base elements in a flexible manner.

In order to accomplish that objective, a method of the kind referred to in the introduction is characterized in that floating elements and rigid elements are supplied first, after which a number of floating elements and a number of rigid elements are joined together, wherein each base element is assembled from floating elements and rigid elements that have been joined together in this manner, after which a number of base elements thus formed are coupled together so as to form the floating base. The essence of the invention is that it departs from base elements which (i) are made up of units that can be produced at low cost anywhere in the world and which are easy to transport and to combine, and which (ii), in coupled-together condition, form a stable, floating base. The base elements can be flexibly coupled together in such a manner that the floating base can have any shape and dimensions that may be desired.

Accordingly, the present invention makes use of pre-formed floating and rigid elements, both types of elements preferably being provided with a quality mark. In this way it can be ensured in advance that the calculated minimum rigidity of the floating base equals the rigidity of the floating base as implemented in practice. For each construction project the required number of floating and rigid elements and the required dimensions of said floating and rigid elements are determined in advance. No concrete is locally poured to form the base elements. The fact is that in those cases in which concrete is poured no clarity can be obtained in advance as to the realised rigidity of the installed floating base. Furthermore, pouring concrete has this drawback that concrete may be wasted, with all the consequent ecological damage, whilst in addition construction depends on all kinds of meteorological conditions in that case.

In one preferred embodiment of a method according to the invention, the floating elements and the rigid elements are joined together on land. In another preferred variant, the floating elements and the rigid elements are joined together on a vessel that floats on the water, such as a work boat or a pontoon. More in particular, a flat bed is first formed on land or on the vessel, after which the floating elements and the rigid elements are joined together on said bed. Said bed, which functions as a supporting surface, is prepared on the land or on the vessel in advance, therefore. A poured concrete floor is very suitable for use as a flat bed. In a first preferred embodiment, the invention therefore proceeds from the idea that the joining together of the floating elements and the rigid elements, i.e. the assembling of the floating base elements ("modules") therefrom, takes place on land, thus avoiding the laborious, time-consuming and dangerous work on the water during that stage. In another, second preferred embodiment the joining together of the floating elements and the rigid elements takes place on the vessel that is floating on the water, such as the aforesaid work boat or pontoon.

In another preferred embodiment of a method according to the invention, the floating elements and the rigid elements are joined together under a bias. As a result of said bias, a friction surface is formed between the floating elements on the one hand and the rigid elements on the other hand. This achieves that the base elements thus assembled remain rigid up to a predetermined, safe load (i.e. bias) and consequently can be transported into the water without any problems. The floating base made up of base elements thus has a guaranteed minimum rigidity so that it can at all times function as an insubmersible base structure, in particular for a building to be placed thereon.

In another preferred embodiment of a method according to the invention, a rod is first passed through the floating elements and the rigid elements, after which the bias is applied by tightening nuts on the rod. In another preferred embodiment, a strap is first arranged round the floating elements and the rigid elements, after which the bias is applied by tightening the strap or pre-tensioning it by means of a "screw clamp method".

In another preferred embodiment of a method according to the invention, the base elements assembled from the joined-together floating elements and rigid elements are placed in the water from the land or from a vessel that floats on the water. The base elements are in particular hoisted into the water from the land or from the vessel, for example by means of a crane. According to another possibility, the base elements slide into the water from the vessel. This preferred embodiment comprises an initial phase, therefore, in which the floating elements and the rigid elements are combined to form the base elements (preferably under a bias, i.e. through friction between the floating elements and the rigid elements) on land or on the vessel, and an end phase, in which the floating base is/has been made up of the coupled-together base elements on the water. Preferably, fixation means are provided on the floating base after the assembly thereof to prevent the floating elements from becoming detached from one base element or from several base elements in case the aforesaid bias should decrease after some time. It is noted that such fixation means can be provided on individual base elements or on a number of base elements lying adjacently to each other. Such a fixation means is in particular a rigid upper plate, such as a poured concrete floor or a constructed wooden, plastic or metal floor.

In another preferred embodiment of a method according to the invention, the floating elements are block-shaped. More in particular, the floating elements are made of expanded polystyrene (hereinafter abbreviated "EPS"), also referred to as "styropor" in practice.

In another preferred embodiment of a method according to the invention, the rigid elements are plate-shaped. The rigid elements are preferably made of concrete. In another preferred embodiment, the rigid elements are made of laminated wood, steel, aluminium or plastic.

In another preferred embodiment of a method according to the invention, base elements positioned adjacently to each other are coupled together on the water by inserting outwardly extending projections of rigid elements of one base element into corresponding slots in rigid elements of the other, adjacent base element. This will be explained in more detail yet in the description of the figures.

In another preferred embodiment of a method according to the invention, fixation means are provided on the coupled-together base elements on the water so as to fix the floating elements in position with respect to the rigid elements. As already noted above, the fixation means are preferably embodied as a rigid upper plate, such as a concrete floor.

The invention also relates to a floating base made up of a number of coupled-together base elements, characterized in that each base element has been assembled from a number of floating elements and rigid elements that have been joined together under a bias (and friction).

The invention will now be explained in more detail with reference to figures illustrated in a drawing, in which FIGS. 1–16 show successive steps of a preferred embodiment of a method for producing a floating base according to the invention.

FIG. 1 shows elements that form components of each base element, viz. floating elements in the form of EPS blocks 1, rigid elements formed by concrete plates or slabs 2, as well as rods and nuts, jointly indicated at 3. These components are readily available and easy to transport, for example by means of a truck.

Figure 2:
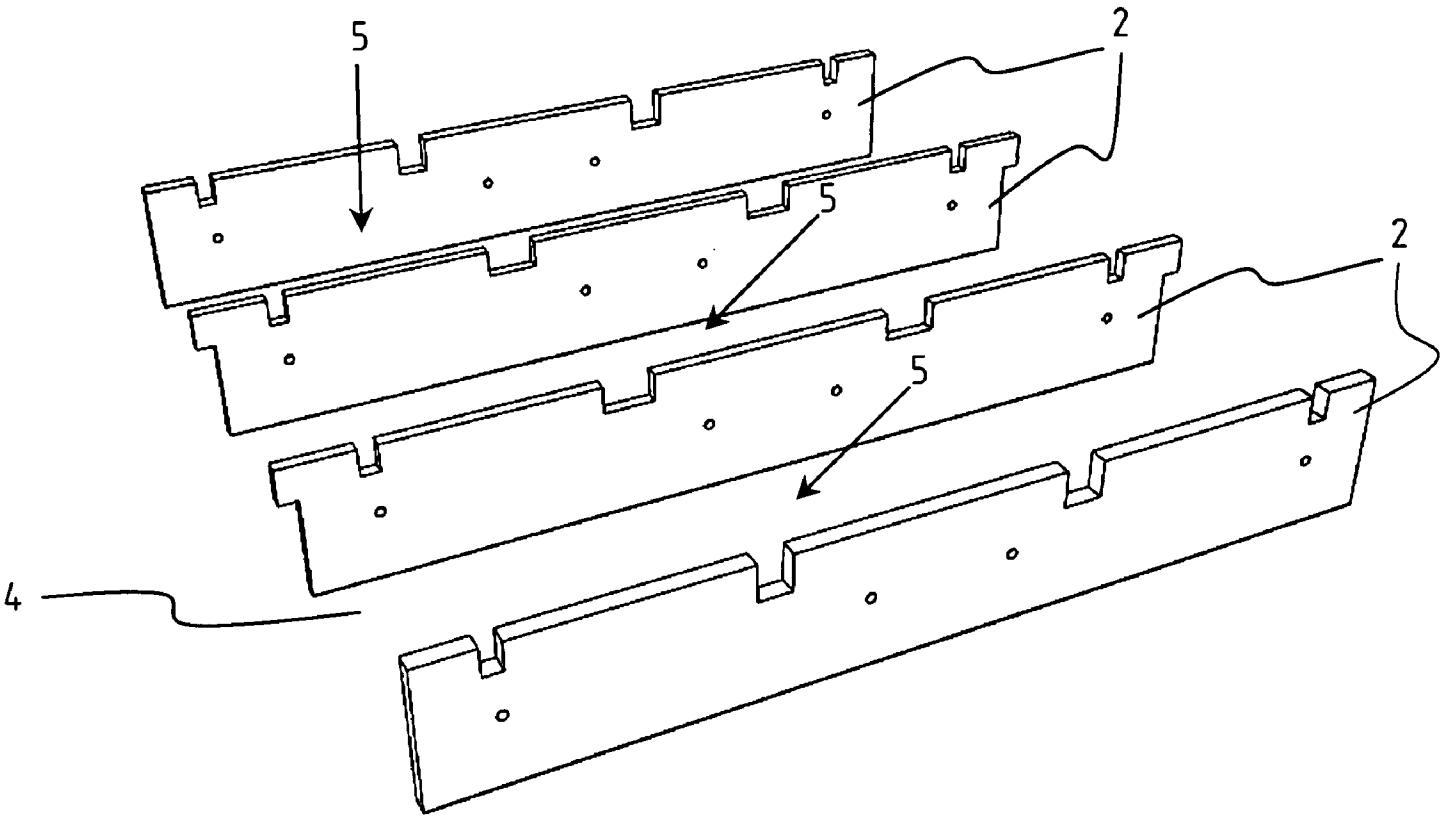

FIG. 2 shows a first step of the production of the floating base, viz. the forming of a flat bed or supporting surface 4 on land. This can be done by pouring a flat concrete floor on the ground or laying a flat floor of wood or plastic on the ground. Possibly, a flat floor consisting of rubble or sand is laid on the ground. The flat bed 4 functions to prevent excessive variations in height between the EPS blocks 1 and the concrete plates or slabs 2 when said elements are being joined together to form base elements for the floating base.

Figure 3:
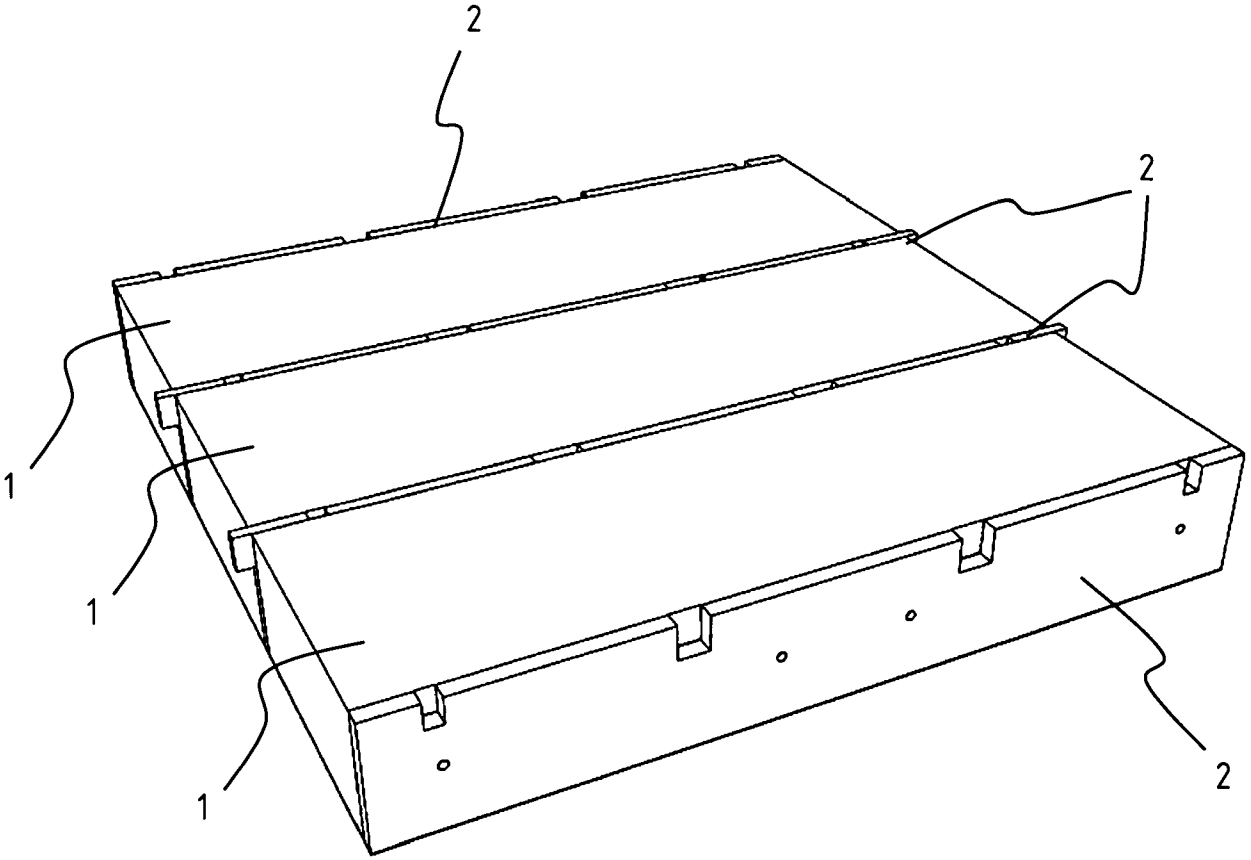
Figure 4:
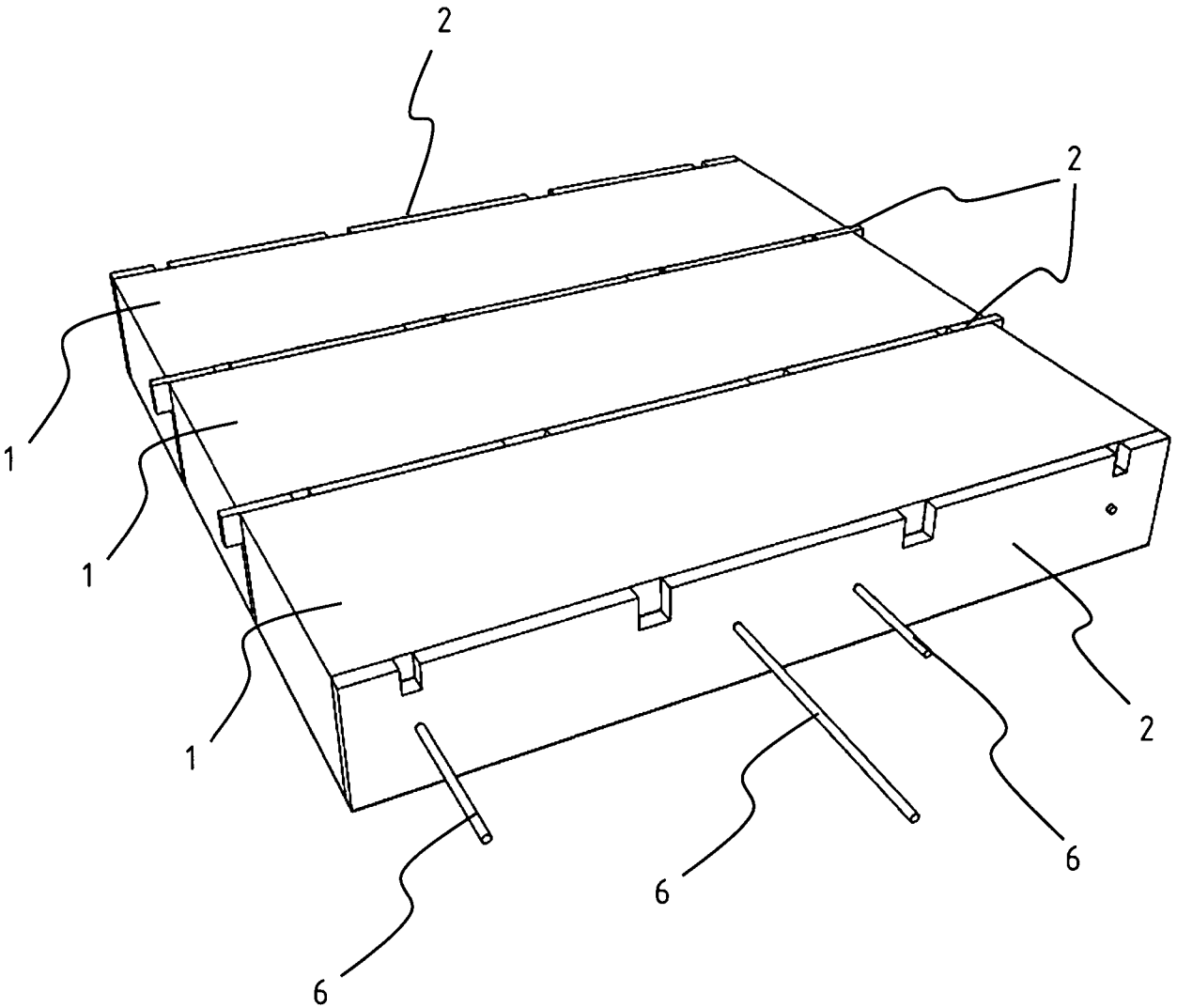
Figure 5:
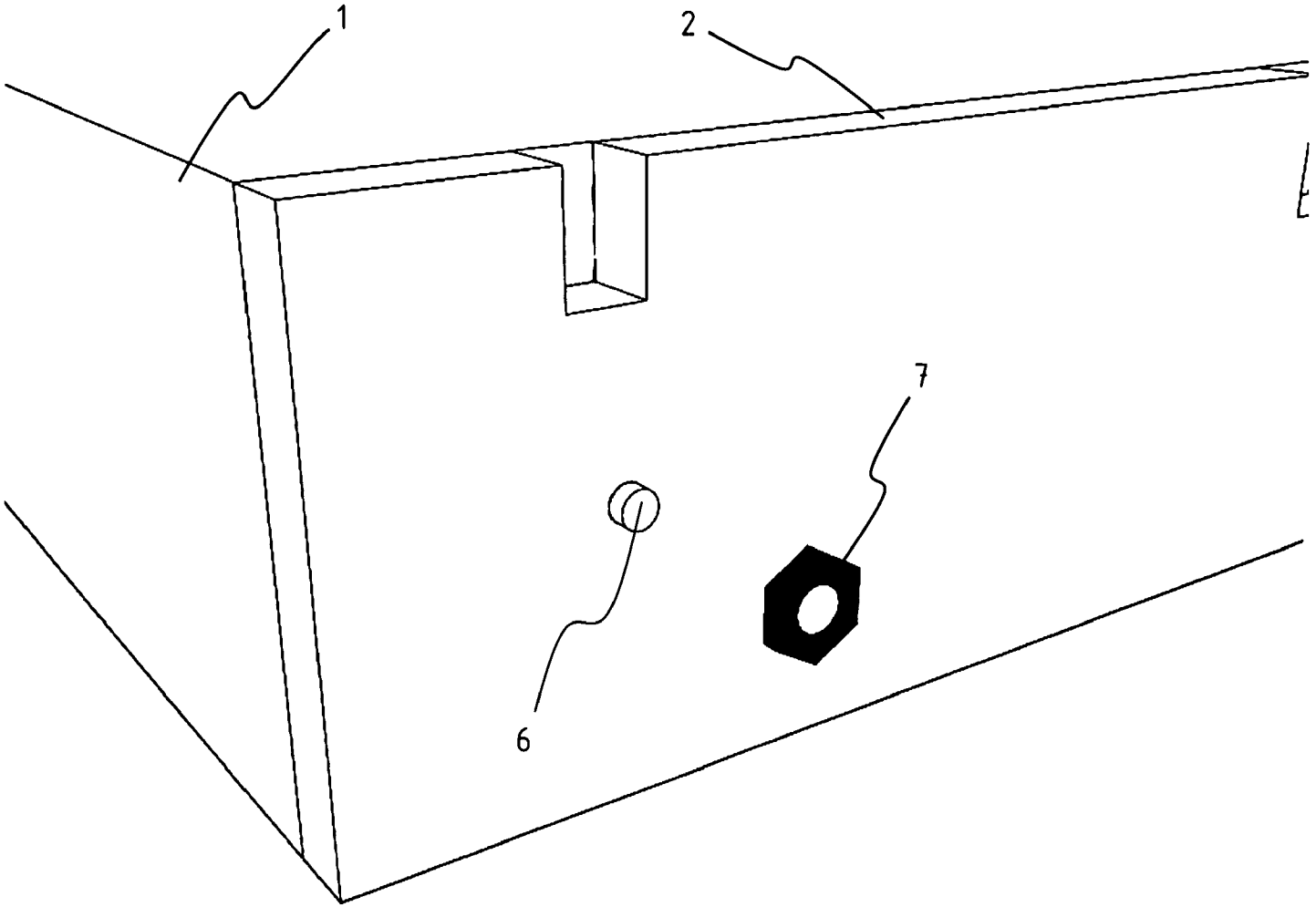
Figure 6:
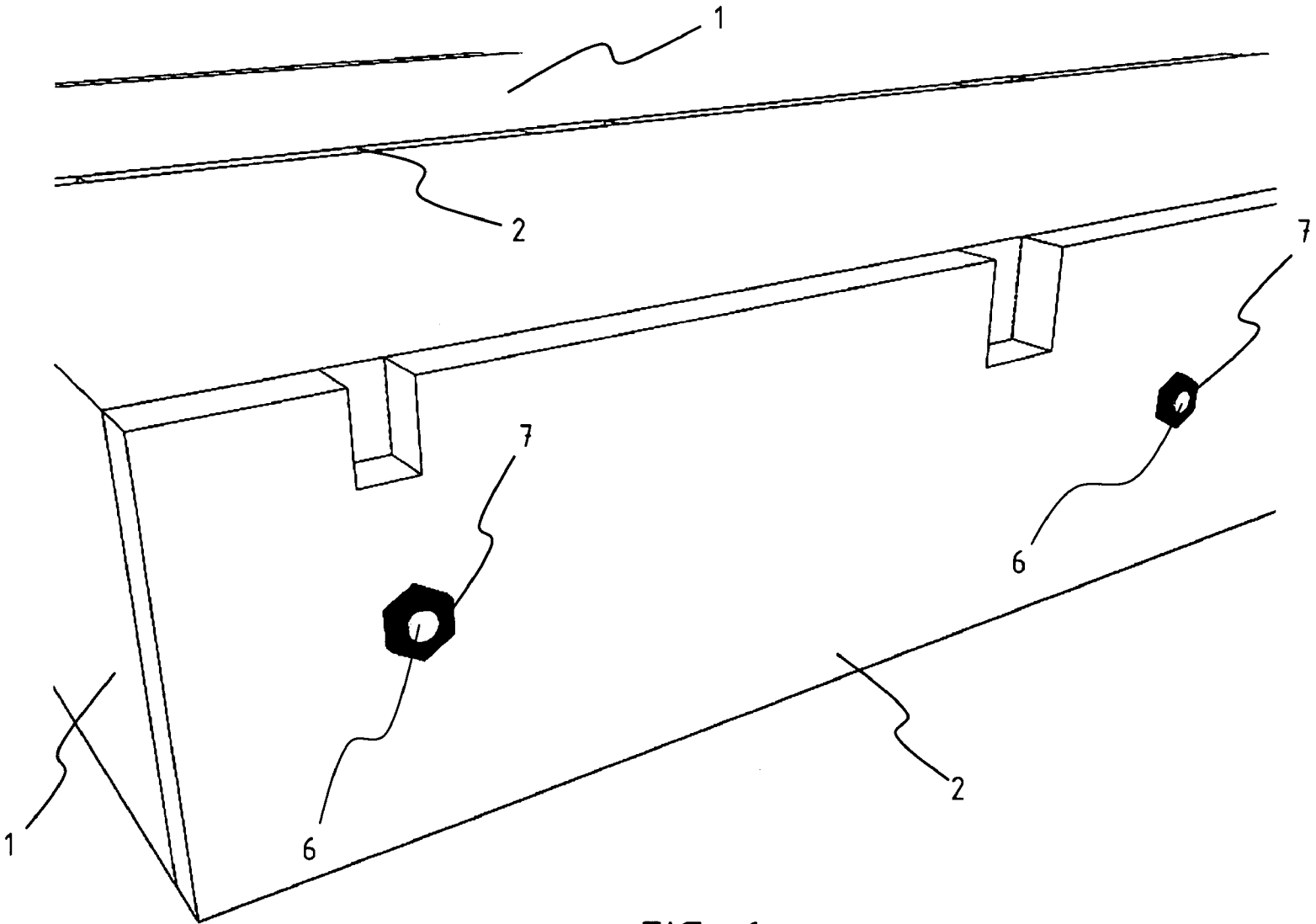

In the second and third step (FIGS. 2 and 3) the concrete plates 2 (slabs) are placed on the flat bed 4 with their narrow longitudinal sides, leaving open a space 5 between the respective plates (FIG. 2). Then an EPS block 1 is placed in each space 5 (FIG. 3). Concrete plates (slabs) 2 and EPS blocks 1 are arranged in alternating relationship (seen in horizontal direction), therefore. In principle it would also be possible to stack the concrete plates 2 (slabs) and the EPS blocks 1 in vertical direction.

Figure 7:
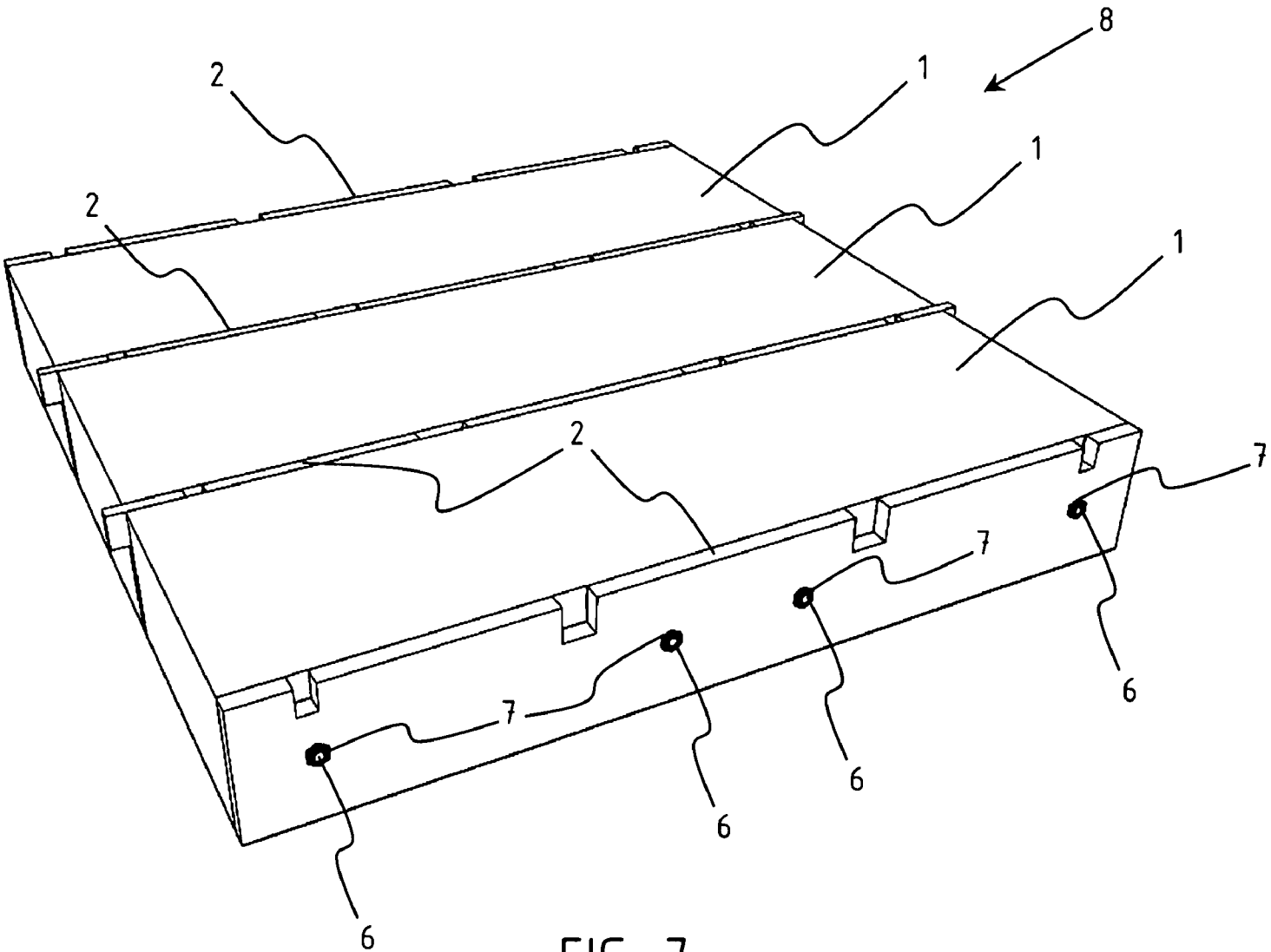

FIGS. 4, 5, 6 and 7 show a fourth step, in which the concrete plates 2 and the EPS blocks 1 of FIG. 3 are joined together under a bias. To that end a bar or rod 6, e.g. of stainless steel, is inserted into pre-drilled holes (not shown) in the concrete plates (slabs) 2 and the EPS blocks 1, after which nuts 7 present on either side of the whole are tightened to at least the calculated bias, thus providing the required friction tension on the contact surfaces of the rigid elements and the floating elements. Thus a biased base element 8 is obtained (FIG. 7). The bias, i.e. the friction between the concrete plates 2 (slabs) in a base element 8 on the one hand and the EPS blocks 1 in a base element 8 on the other hand provides (i) the required rigidity of the base element 8, as a result of which the base element can be transported (for example hoisted or slipped) into the water as an independent "module" and (ii) the rigidity required for provisionally keeping the base elements 8 together on the water. After a concrete floor 17 has been poured on individual base elements 8 or on several base elements together, the aforesaid bias (i.e. friction between the elements 1, 2 in the base elements 8 ("modules")) is no longer required. The fact is that the concrete floor 17 provides the necessary rigidity in that case. In the unlikely event that the aforesaid bias should be lost entirely or partially after some time, the concrete floor 17 will prevent the EPS blocks 1 from becoming detached from one base element or several base elements. The concrete floor 17 will function as a fixation element in that case to hold the EPS blocks 1 in place.

Figure 8:
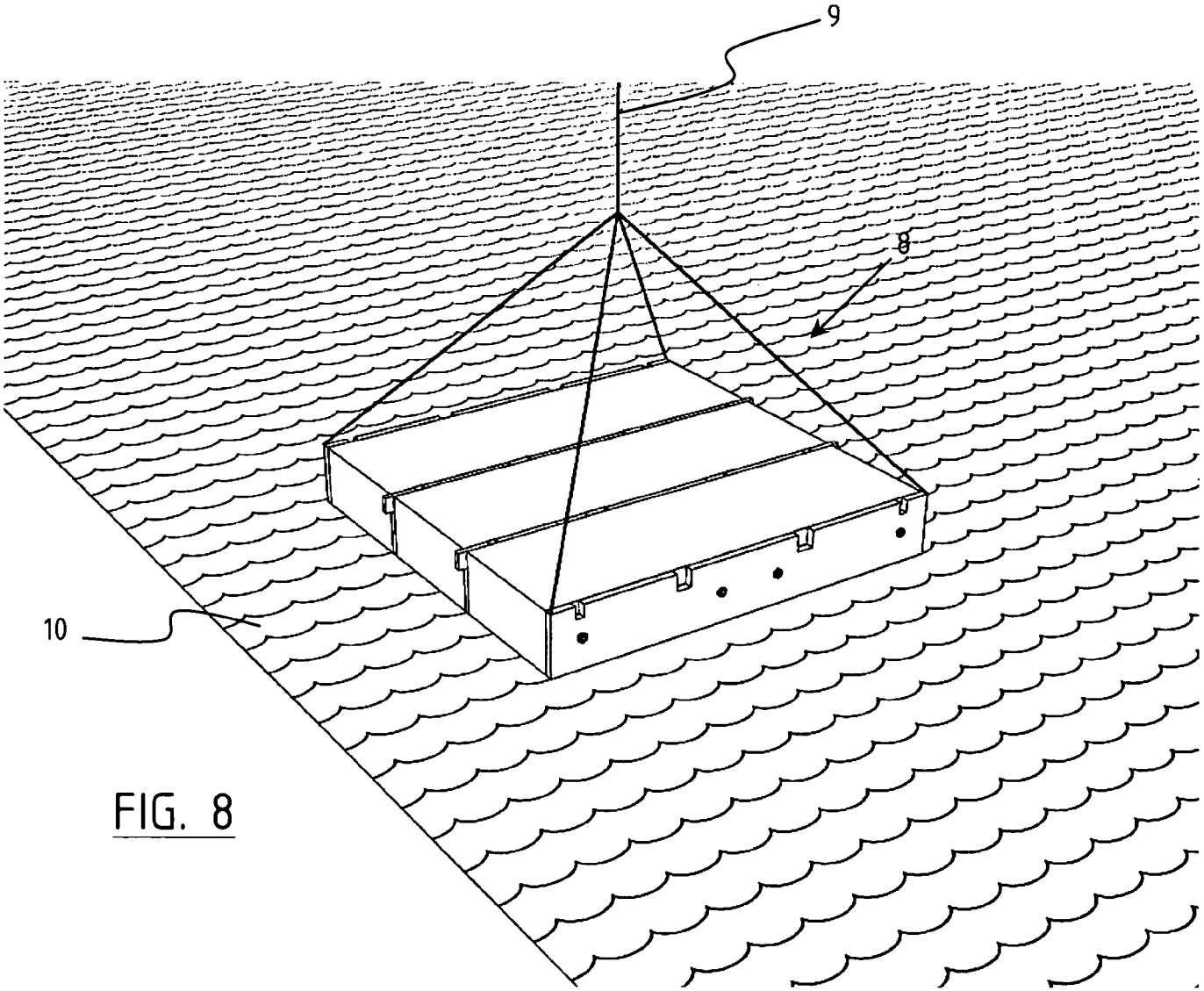
Figure 9:
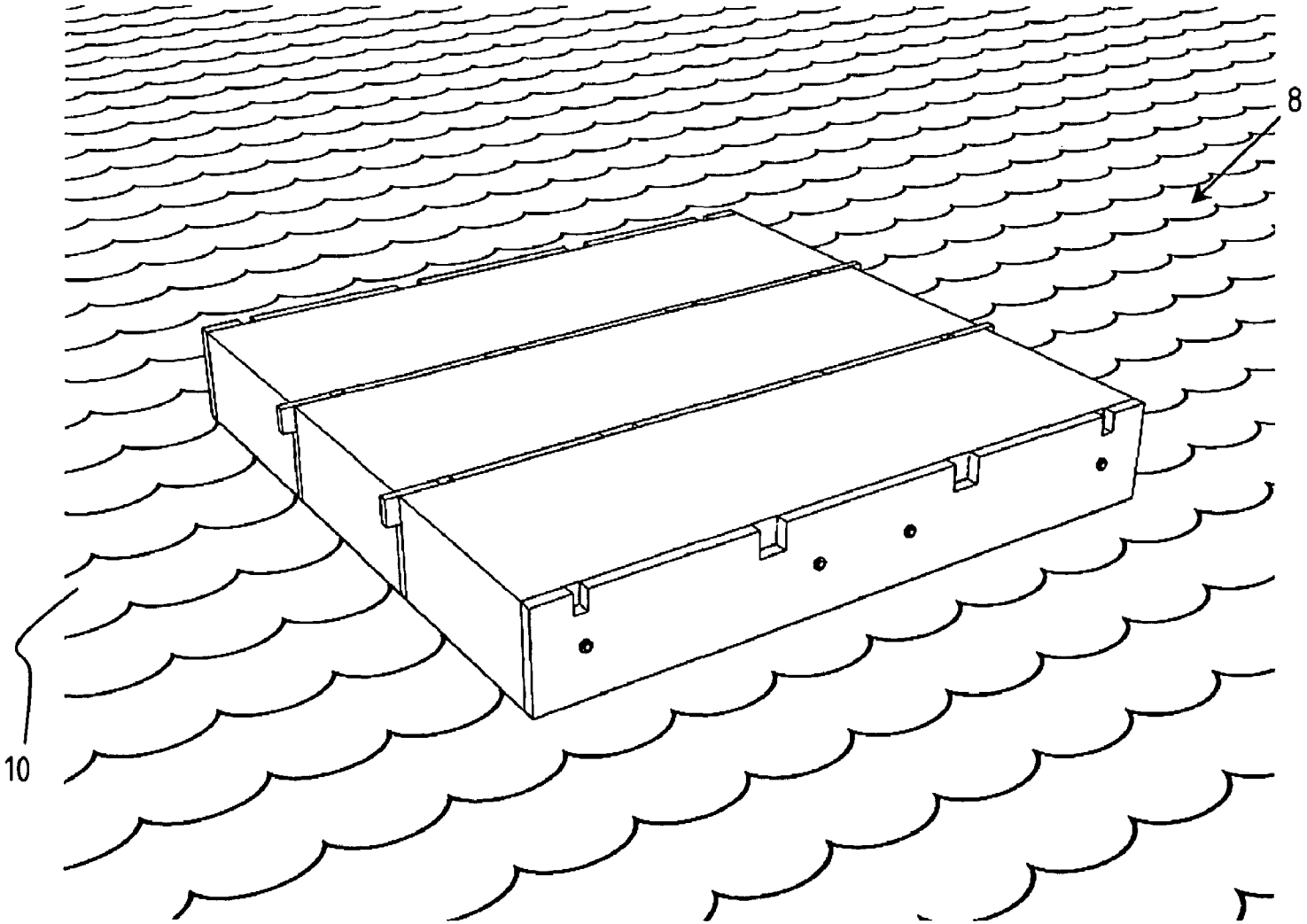

FIGS. 8 and 9 show in a fifth step the manner in which a base element 8 that has been built up on land is hoisted onto or into the water from the land by means of a crane.

Figure 10:
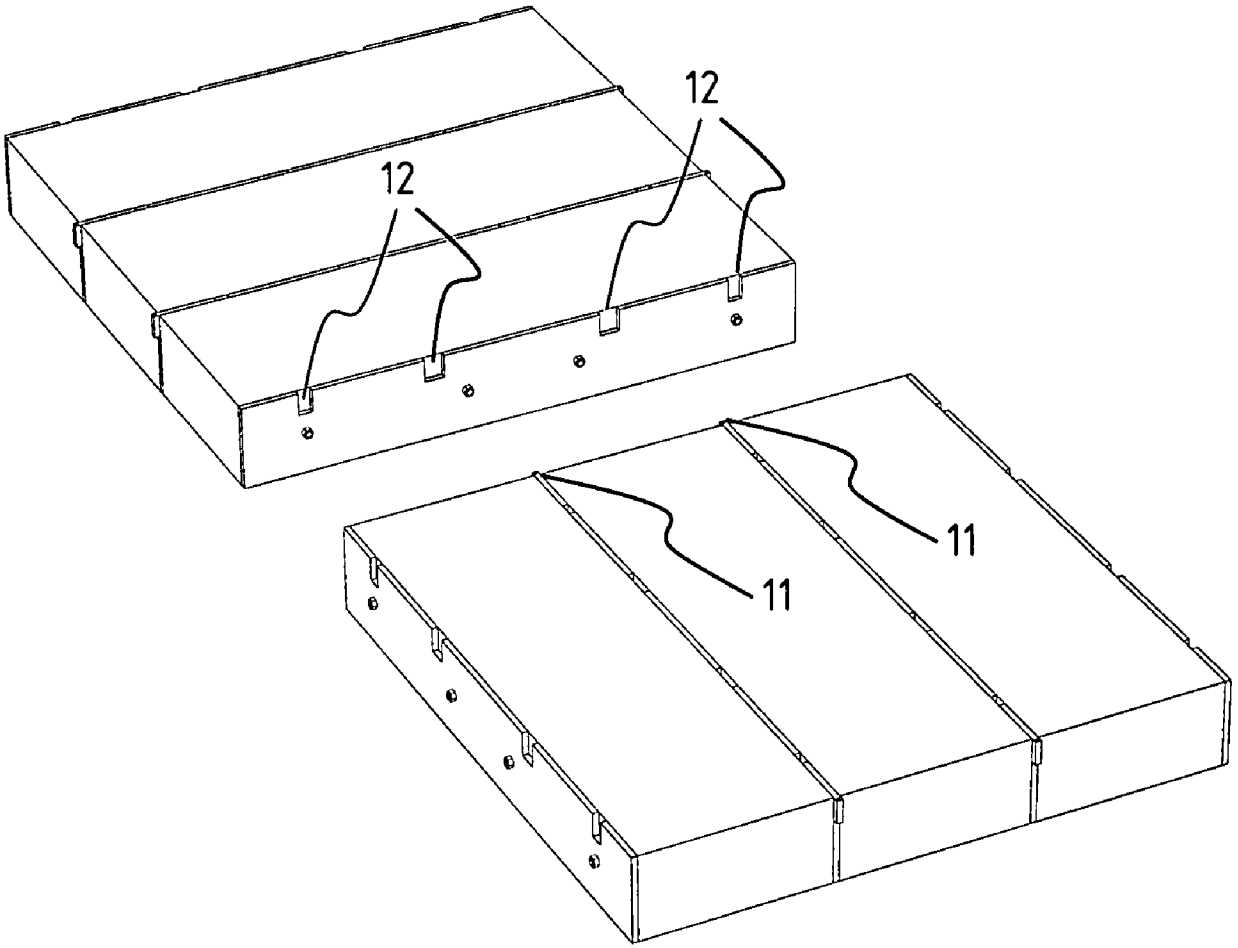
Figure 11:
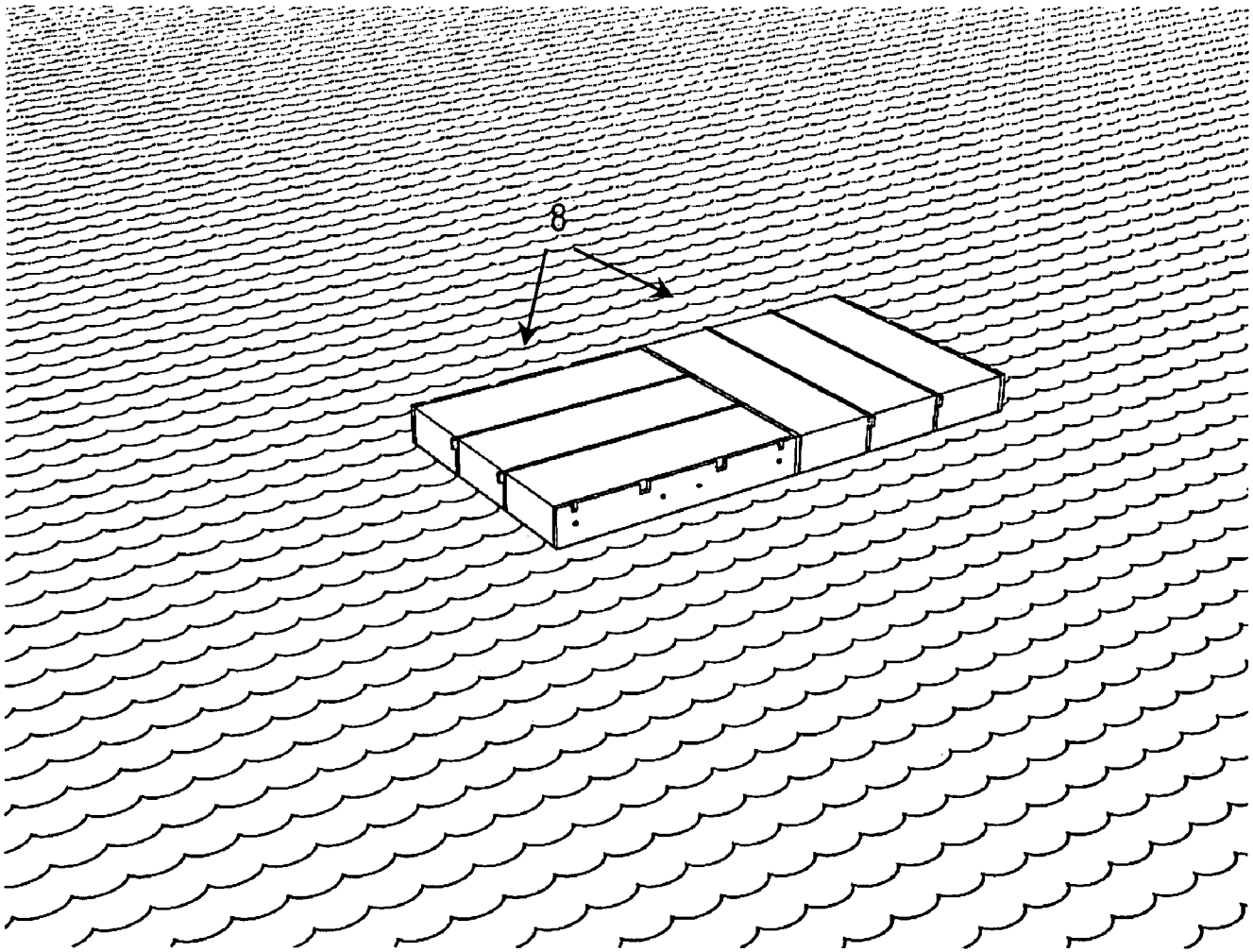
Figure 12:
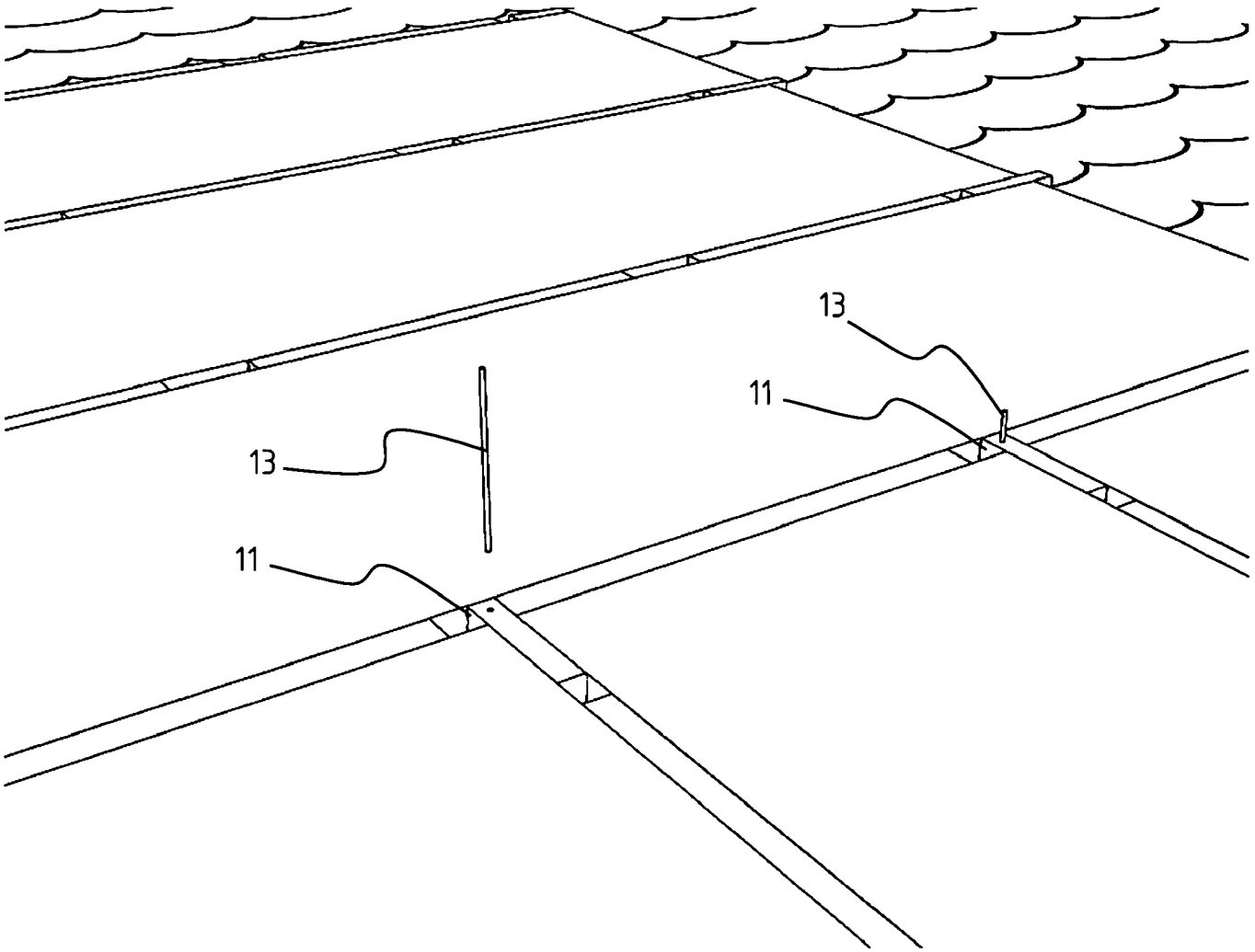
Figure 13:
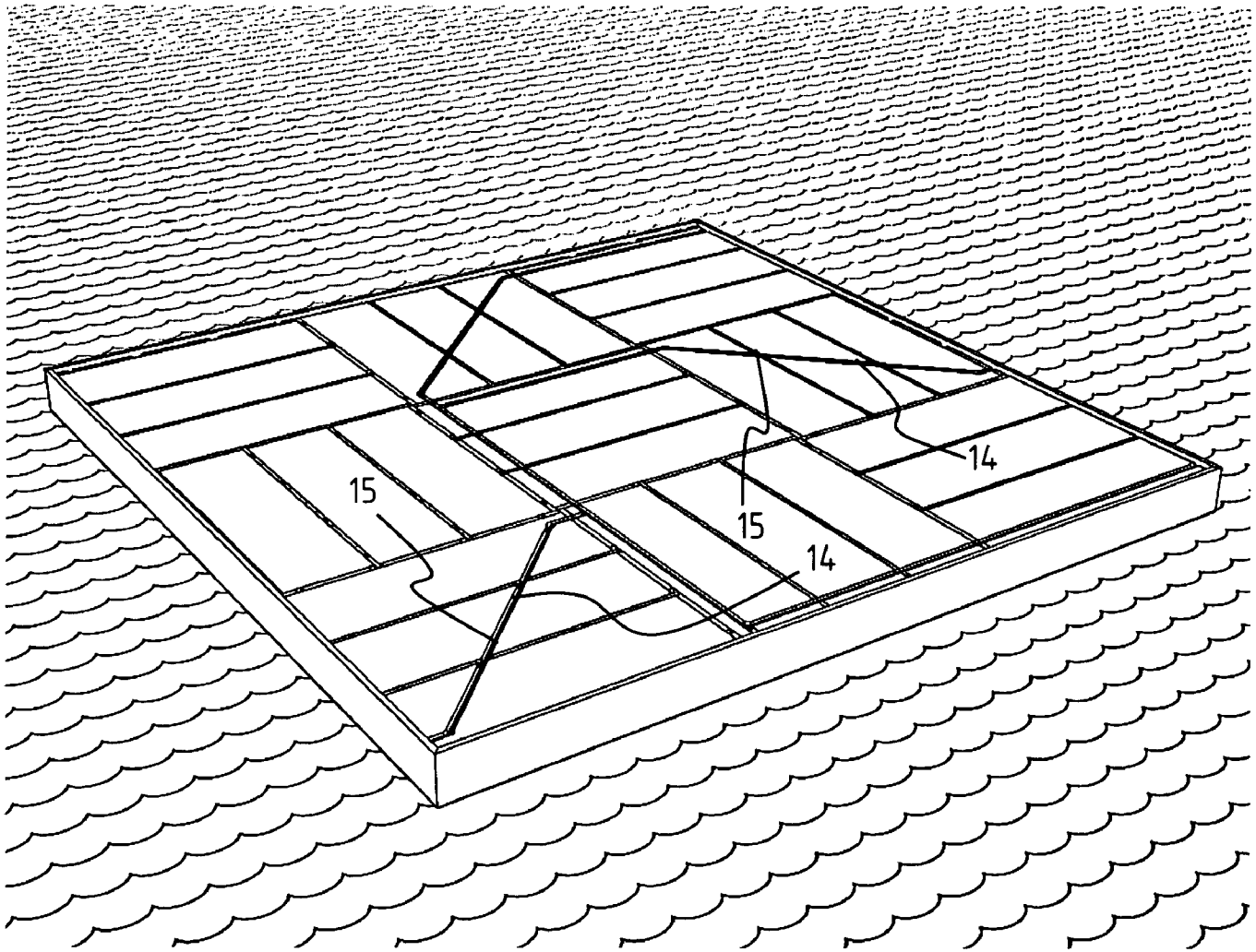
Figure 14:
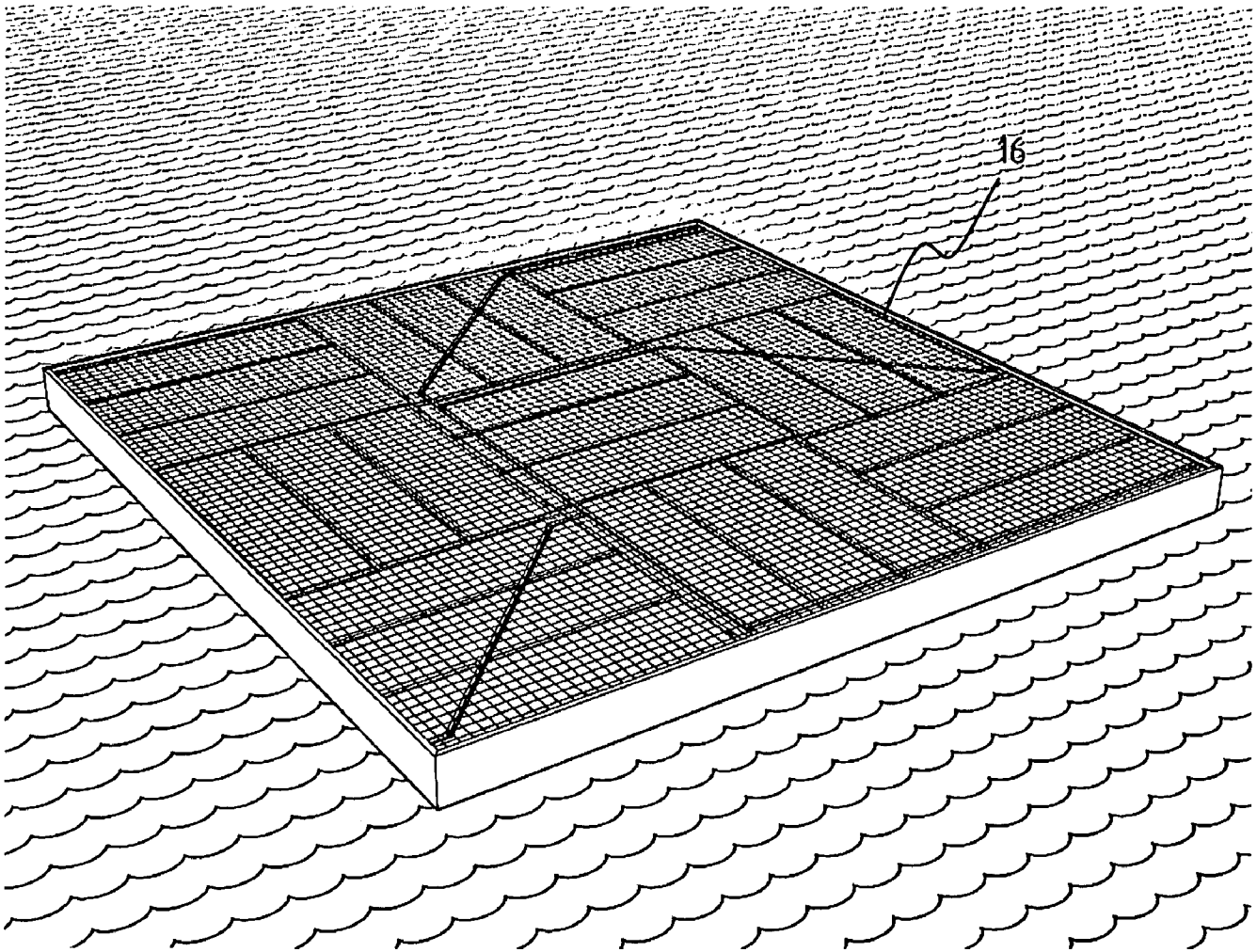
Figure 15:
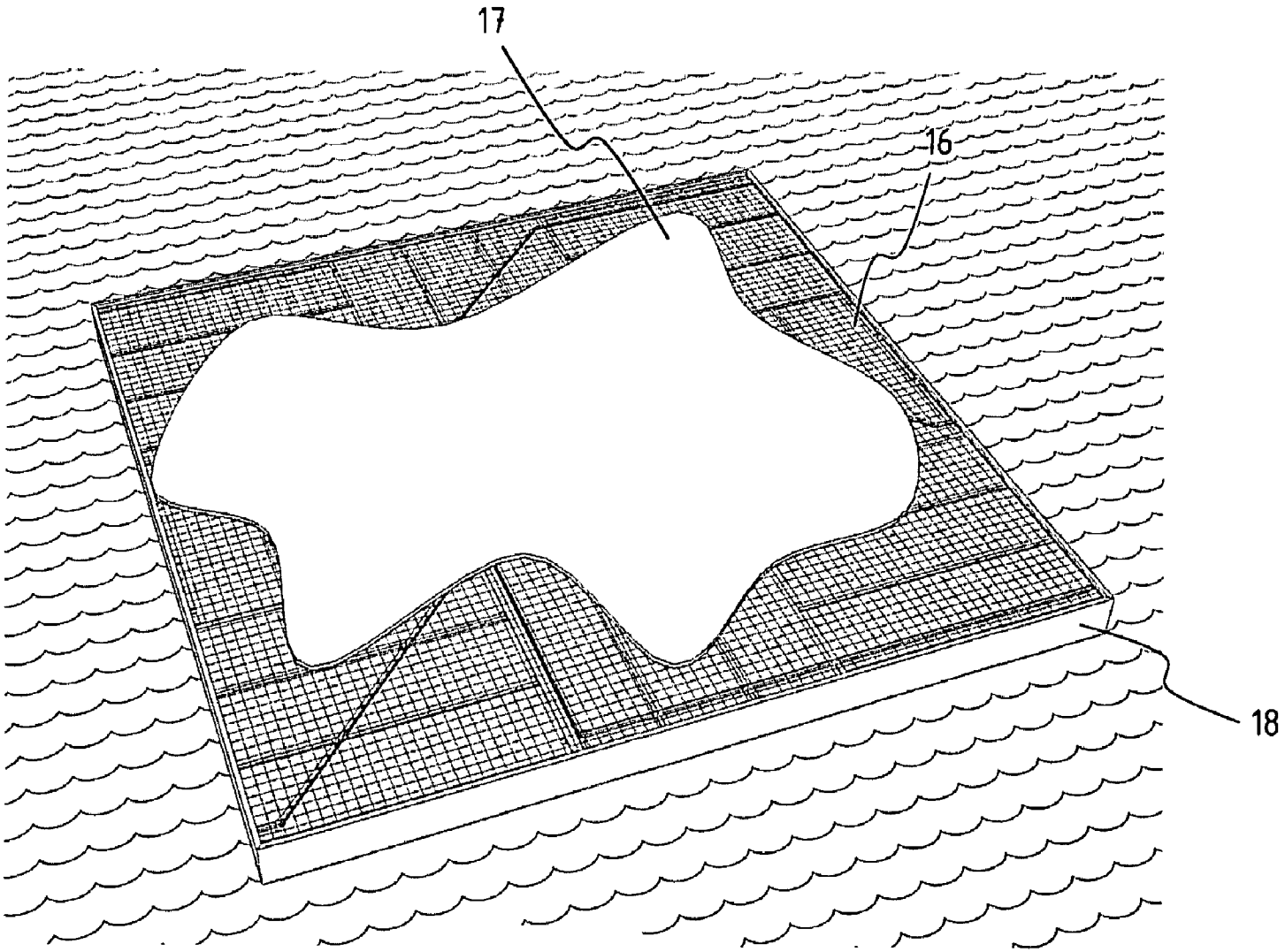
Figure 16:
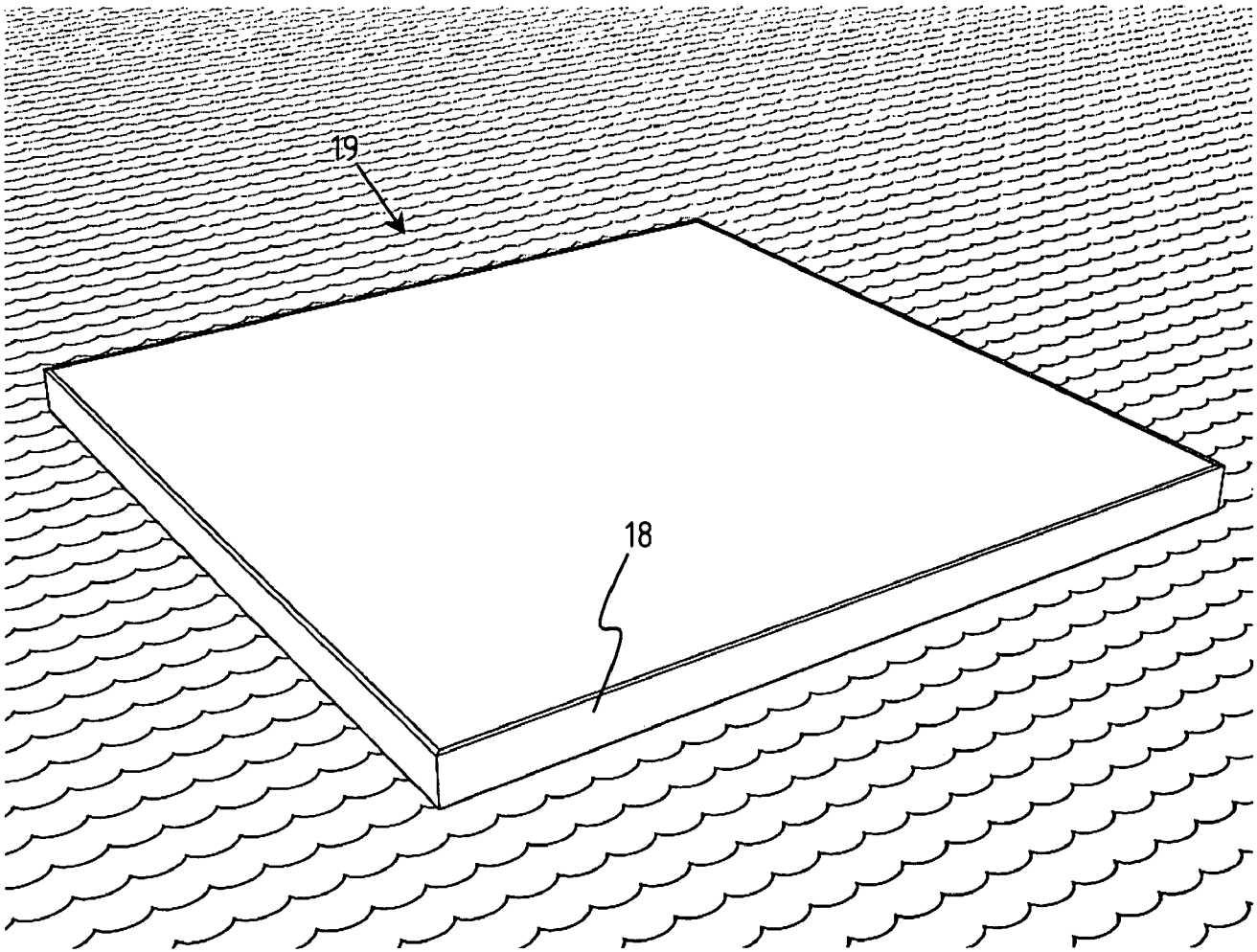

FIGS. 10–16 show next steps, in which the floating base is assembled by coupling or linking together base elements 8 positioned adjacently to each other, as shown in FIGS. 8 and 9. The base elements 8 are preferably laid alternately in longitudinal direction and in transverse direction (FIGS. 10 and 11) on the water. The coupling together of adjacent base elements 8 takes place by inserting projections 11 on the concrete plates 2 of one base element 8 into slots 12 in the concrete plates 2 of the other base element 8, and subsequently inserting locking pins 13 vertically into the projections 11 (FIGS. 10, 11 and 12). FIG. 13 shows the installation of pipes 14 (e.g. water pipes, electric lines, sewage pipes) in the coupled-together base elements 8, which pipes 14 are installed in channels 15 milled in situ in the concrete plates 2 and the EPS blocks 1 of the base elements 8. Possibly, pre-formed channels 15 or holes are formed. Finally, a fabric 16 ("reinforcing web") is laid on top of the floating base, after which the concrete floor 17 is poured (FIGS. 14 and 15). Before the concrete is poured, a formwork 18 is placed all around the base. The floating base (indicated at 19 in FIG. 16) is now ready to function as a floating base structure for all kinds of functional structures, such as one or more buildings, green areas, infrastructure (roads, railway lines and the like), airfields, sports fields, etc. The floating base 19 is a very stable in the sense that it will exhibit hardly any swell-induced rolling motion, if at all.

It is noted that the invention is not limited to the illustrated embodiment, but that it also extends to other preferred variants that fall within the scope of the appended claims. Thus it will be apparent to those skilled in the art that the blocks 1 and the plates 2 may have any desired shape and dimension and need not necessarily be made of EPS and concrete, respectively, with this understanding that a floating material and a rigid material, respectively, must be used. In this context the term floating material is understood to be a material having a specific weight less than or equal to 1 $g/cm^3$. Furthermore it will be apparent to those skilled in the art that the blocks 1 and the plates 2 need not necessarily be positioned on the water in the illustrated configuration, but that any desired pattern is possible. Finally it will be apparent to those skilled in the art that instead of the concrete floor 17 any fixation means may be used for holding the floating elements in place when the bias is at least partially lost, for example a rigid upper plate made of wood, a metal or a plastic.

The invention claimed is:

1. A method for producing a floating base including coupled-together base elements, comprising:

supplying block-shaped floating elements and plate-shaped rigid elements;

joining a plurality of the floating elements and a plurality of the rigid elements together under pressure, on land or on a vessel that floats on water, to form base elements;

placing the base elements assembled from the joined floating elements and rigid elements in the water;

coupling together a plurality of base elements; and fixing the floating elements in position with respect to the rigid elements on the water, by a fixation device provided on the coupled-together base elements so as to fix the floating elements in position with respect to the rigid elements to produce the floating base.

2. The method according to claim 1, further comprising:

forming a flat bed on land or on the vessel; and joining together the floating elements and the rigid elements on said bed.

3. The method according to claim 2, wherein said flat bed is made up of a concrete floor formed on land or on the vessel.

4. The method according to claim 1, wherein the joining step includes passing a rod through the floating elements and the rigid elements, after which the pressure is applied by tightening nuts on the rod.

5. The method according to claim 1, wherein the base elements are hoisted into the water.

6. The method according to claim 1, wherein the floating elements are at least substantially made of EPS.

7. The method according to claim 1, wherein the rigid elements are at least substantially made of concrete.

8. The method according to claim 1, wherein base elements positioned adjacently to each other are coupled together on the water by inserting outwardly extending projections of rigid elements of one base element into corresponding slots in rigid elements of another, adjacent base element.

9. A method for producing a floating base including coupled-together base elements, comprising:

supplying block-shaped floating elements and plate-shaped rigid elements;

joining a plurality of the floating elements and a plurality of the rigid elements together under pressure, on land or on a vessel that floats on water, to form base elements, including arranging a strap around the floating elements and the rigid elements, after which the pressure is applied by tightening the strap; and coupling together a plurality of base elements.

* * * * *